US005275234A

United States Patent [19]

Booth

[11] Patent Number: 5,275,234

[45] Date of Patent: Jan. 4, 1994

[54] SPLIT RESISTANT TUBULAR HEAT TRANSFER MEMBER

[75] Inventor: Steven R. Booth, Benton, La.

[73] Assignee: Heatcraft Inc., Grenada, Mo.

[21] Appl. No.: 703,170

[22] Filed: May 20, 1991

[51] Int. Cl.[5] ..... F28F 1/40

[52] U.S. Cl. ..... 165/133; 165/179

[58] Field of Search ..... 165/179, 184, 133; 29/890.048, 890.049

[56] References Cited

U.S. PATENT DOCUMENTS

| | | | |
|---|---|---|---|
| 3,273,599 | 9/1966 | Heeren | 165/179 |
| 3,847,212 | 11/1974 | Withers, Jr. et al. | 165/179 |
| 4,044,797 | 8/1977 | Fujie et al. | 138/38 |
| 4,118,944 | 10/1978 | Lord et al. | 62/98 |
| 4,658,892 | 4/1987 | Shinohara et al. | 165/133 |
| 4,660,630 | 4/1987 | Cunningham et al. | 165/179 |
| 4,809,415 | 3/1989 | Okayama et al. | 165/133 |
| 4,938,282 | 7/1990 | Zohler | 165/133 |

FOREIGN PATENT DOCUMENTS

| | | | |
|---|---|---|---|
| 140598 | 8/1983 | Japan | 165/179 |
| 265499 | 11/1986 | Japan | 165/179 |
| 276397 | 12/1987 | Japan | 165/179 |
| 172893 | 7/1988 | Japan | 165/179 |
| 299707 | 12/1989 | Japan | 29/890.049 |

*Primary Examiner*—John Rivell
*Assistant Examiner*—L. R. Leo
*Attorney, Agent, or Firm*—Allegretti & Witcoff, Ltd.

[57] ABSTRACT

The improved split resistant tubular heat transfer member of the present invention is directed to an elongated tube having a substantially circular transverse cross-section. The elongated tube hereof has an outer surface and an inner surface, and further has an outer diameter, a defined wall thickness, and an inner diameter. The tube inner surface has disposed therein a plurality of spiral grooves, defining and separating a corresponding plurality of spirally disposed fins extending from the inner diameter of the tube. The respective spirally disposed fins have an inverted substantially V-shape and have further an apex angle of approximately 28°. In some such preferred embodiments the spiral grooves have a ratio of the cross-sectional area thereof to the depth thereof of approximately 0.01475 inches.

13 Claims, 1 Drawing Sheet

SPLIT RESISTANT TUBULAR HEAT TRANSFER MEMBER

BACKGROUND OF THE INVENTION

The present invention relates to heat exchangers in general and more particularly to an improved split resistant tubular heat transfer member through which refrigerant liquid flows and functions to evaporate or to condense, thereby respectively to accept heat from and to provide heat to a coolant fluid which is disposed in contact with the exterior of the tubular member. Yet further, the present invention is directed to a particularized structure for a tubular heat transfer member which provides resistance to splitting during the manufacture thereof, and does so while retaining its beneficial heat exchange characteristics.

The improved split resistant tubular heat transfer member of the present invention is of the variety used in refrigeration and air conditioning systems utilizing an evaporator and condenser. Generally, the evaporator and condenser are comprised of a plurality of parallel tubes connected at the end to form a refrigerant circuit or circuits. A plurality of fins are connected in heat exchange relationship to the tubes and extend transversely of the tubes. In use, refrigerant is condensed in the condenser and evaporated in the evaporator. Liquid or air is passed over the condenser to condense the refrigerant fluid therein. Air passed over the evaporator is cooled. Cooled air from the evaporator may be used to cool the interior of a space, e.g. room to be cooled.

In the above generalized procedure of refrigerating or air conditioning, the physical characteristics of the heat exchange tube determines the heat transfer efficiency. One certain type of heat transfer tubes which have found acceptance in the prior art utilize a multiplicity of rib-like projections, or "fins", disposed on the interior surface of the tube. In such heat transfer apparatus, a thin film layer of refrigerant liquid is maintained in contact with the interior surface of the tube, and in particular is disposed on the surface of the fins and the grooves therebetween. If the tube used in an evaporator application, this thin film layer is the subjected to evaporation. The multiplicity of rib-like fins increases the surface area available for evaporation and accordingly increases the efficiency of such evaporation. In some prior art ribbed tubing structures, the ribs are disposed in a spiral or helical disposition to cause a controlled degree of turbulence in the refrigerant liquid, which diminishes laminar flow and also serves to break up any insulating barrier layer of vapor from forming on the interior surfaces of the tube.

Several prior art patents have made proposals for improvement of interior rib-containing tubular heat transfer members. Those prior art patents include:

U.S. Pat. No. 4,044,797—Fujie
U.S. Pat. No. 4,480,684—Onishi
U.S. Pat. No. 4,545,428—Onishi
U.S. Pat. No. 4,658,892—Shinohara
U.S. Pat. No. 4,938,282—Zohler
U.S. Pat. No. 4,921,042—Zohler
U.S. Pat. No. 4,118,944—Lord, et al.

These and other various tubular members of the prior art, including several different forms of interiorly disposed rib structures have increased somewhat the efficiency of refrigerant operation. However, such tubing has in several particulars been difficult or inefficient of manufacture, and has likewise resulted in a tendency to split the tube during manufacture.

Rifle tube is used in the manufacture of heat transfer devices called "coils". The coils are constructed by placing tubes (aluminum or copper) through holes stamped into thin sheets of aluminum or copper. For assembly purposes the tube must be smaller than the holes in the sheets, but for heat transfer purposes the tube must be in intimate contact with the sheets. To achieve the intimate contact, a ball is forced through the tube after it is inserted into the sheets. The ball causes the OD of the tube to "expand" into intimate contact with the sheets. This is called the "expansion process".

On smooth tube, the expansion process works well and causes few problems. However, with rifle tube the stress caused by the expansion process is increased in the thin part of the tube wall, causing the tube to split if there is even a minimal defect in the tube. It has been found by the applicants herein that, by increasing the amount of wall available (bottom wall to fin wall ratio) to accommodate the required expansion, the likelihood of the tube splitting can be reduced.

In view of the above difficulties, defects and deficiencies of prior art structures, it is a material object of the improved tubular heat transfer member of the present invention to provide a novel structure having increased resistance to splitting during the manufacture thereof, while at the same time retaining the beneficial heat transfer characteristics of interiorly ribbed tubular heat transfer members.

In addition, the improved split resistant tubular heat transfer member of the present invention has the further beneficial characteristic wherein the fins thereof hold their shape better during the expansion process, thus permitting the structure to retain a larger degree of its beneficial heat transfer characteristics after the expansion process than prior art tubing has been able to accomplish heretofore.

It is a further object of the present invention to provide a versatile and novel tubular structure which may be utilized for evaporation and for condensation functions. These and other objects and advantages of the improved split resistant tubular heat transfer member of the present invention will become known by those skilled in the art upon a review of the following summary of the invention, brief description of the drawing, detailed description of preferred embodiments, appended claims and accompanying drawing.

SUMMARY OF THE INVENTION

The improved split resistant tubular heat transfer member of the present invention is directed to a structures having an enhanced interior surface thereof. This heat transfer tube interior surface enhancement, is directed to the form of a plurality of spaced ribs alternatingly disposed with a corresponding plurality of grooves. Suitable tubing for use in connection with the present invention has a thin side wall and is generally formed of refrigeration grade copper tubing.

The improved structure of the split resistant tubular heat transfer member of the present invention provides an improved resistance to splitting during formation. The detrimental phenomenon of splitting occurs during the tube expansion process for formation of such group and rib structures. The cause of the splitting phenomenon is believed to be due to the necessity for sections of the tube between the fins to accommodate the stretch required by the expansion process, which necessarily causes increased stress to these areas of the wall.

In particular, the improved split resistant tubular heat transfer member of the present invention is directed to an elongated tube having a substantially circular outside diameter and inside diameter. The elongated tube has an outer surface and an inner surface, and further has an outer diameter, a defined wall thickness, and an inner diameter. The tube inner surface has disposed thereon a plurality of spiral grooves, defining and separating a corresponding plurality of spirally disposed fins extending from the inner diameter of the tube. The respective spirally disposed fins have an inverted substantially V-shape and have further an apex angle of approximately 28°. In a preferred embodiment, the spiral grooves have a ratio of the cross-sectional area thereof to the depth thereof of approximately 0.01475 inches.

BRIEF DESCRIPTION OF THE DRAWING

The improved split resistant tubular heat transfer member of the present invention is set forth in the accompanying drawing, and in which common numerals are utilized for common elements, and wherein.

DETAILED DESCRIPTION OF PREFERRED EMBODIMENTS

Figure 1:
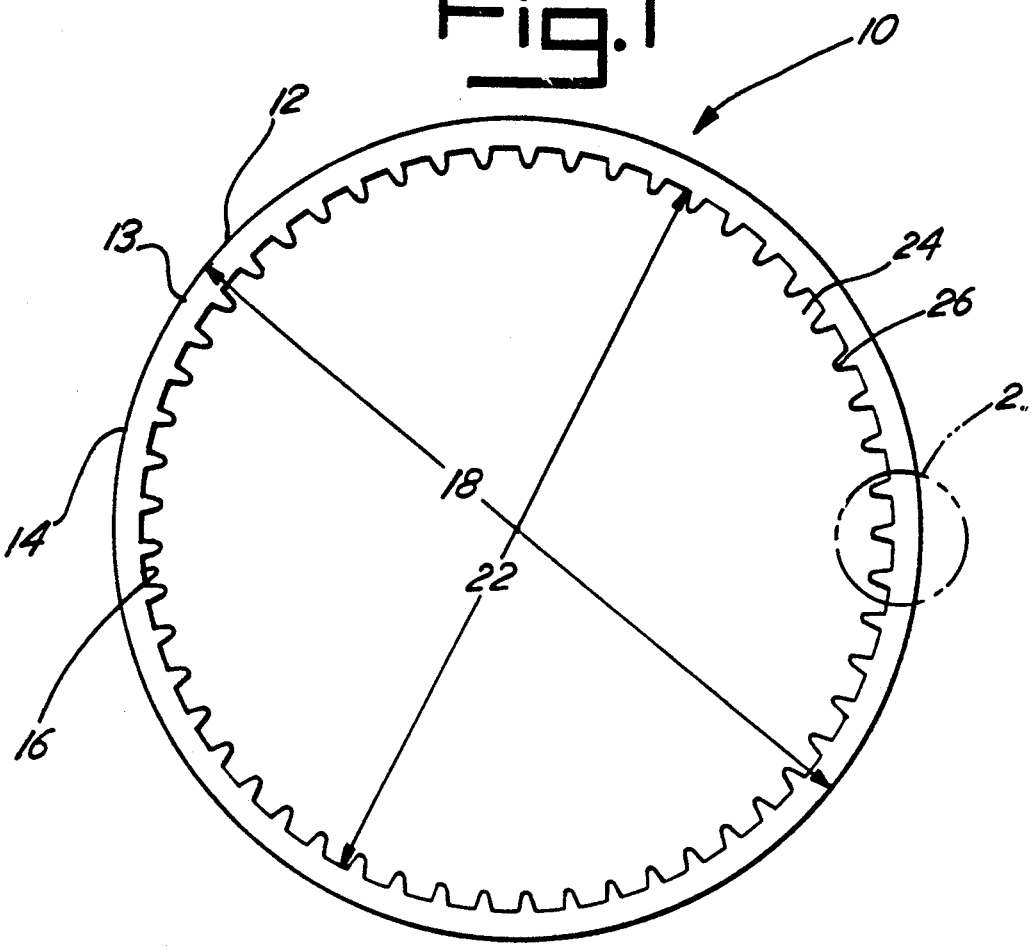
FIG. 1 is a transverse cross-sectional view through a portion of the improved split resistant tubular heat transfer member of the present invention and showing the outer and inner diameter surfaces thereof with the inner surface having a plurality of spirally disposed grooves thereon to define and separate a corresponding plurality of spirally disposed fins, each of which in this embodiment has an inverted V-shape with rounded tip.
Figure 2:
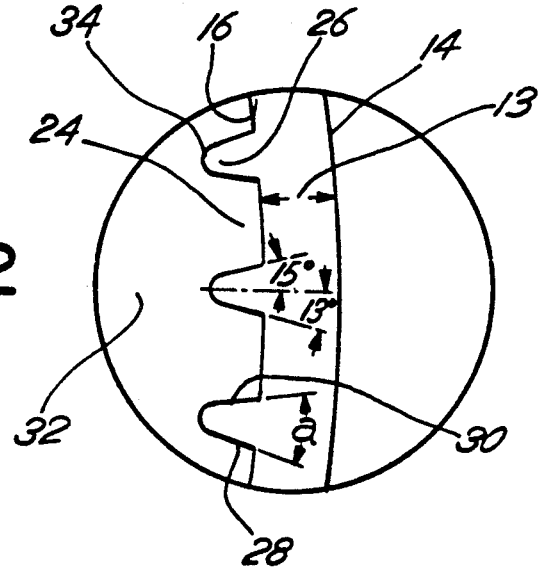
FIG. 2 is an enlarged view of a portion of the wall structure of the improved split resistant tubular heat transfer member as shown in FIG. 1, and further showing the apex of the inverted substantially V-shaped fins, such apex having an angle of approximately 28°, and further showing the relative relationships of the cross-sectional area of the spiral grooves to the height of such spirally disposed fins, as well as the thickness of the tubular member wall.

Referring now to FIGS. 1 and 2 of the drawing, the improved split resistant tubular heat transfer member 10 of the present invention is directed to an elongated tube 12 having a substantially circular outside diameter and inside diameter defining there between transverse cross-section 13. Elongated tube 12 hereof has an elongated outer surface 14 and an inner elongated surface 16. The transverse cross-section 13 represents the wall thickness. Tube inner surface 16 has disposed therein a plurality of spiral grooves 24, defining and separating a corresponding plurality of spirally disposed fins 26 extending from inner diameter 22 of tube 12. Respective spirally disposed fins 26 have sloped sides 28,30 defining an inverted substantially V-shape and have further an apex angle a of approximately 28°. In the embodiment of FIGS. 1 and 2, the spiral grooves 24 have a ratio of the cross-sectional area thereof to the depth thereof of approximately 0.01475 inches.

As shown in FIG. 2, the distance along the curve of the inner surface of the tube between the termination of one fin, for example at slope side 30 of an inverted v-shaped fin 26, and the beginning of the next fin, this distance is known in the art as the "bottom wall distance". The distance along the curve of the inner surface between the beginning of a fin and the termination of the same fin (i.e., the distance along the curve of the inner surface between the bottom portions of slope sides 28,30 of an inverted v-shaped fin 26 is known to those skilled in the art as the "fin wall distance".

In a preferred embodiments of the improved split resistant tubular heat transfer member 10 of the present invention, elongated tube 12 has preferably approximately 50 of the spirally disposed fins 26, although one especially preferred embodiment has 53 such spirally disposed fins 26. However, the number of spirally disposed fins may vary depending upon other dimensions of heat transfer member 10.

As shown in FIG. 2 and in these and other preferred embodiments, the apex angle of fin 26 is preferably asymmetrical with respect to a radius 32 of the circular transverse cross-sectional shape. Such radius 32 intersects a spirally disposed fin 26 to form respective angles of approximately 13° and approximately 15° with regard to sloped sides 28,30 of the inverted V-shaped fin 26. In such a manner, sloped sides 28,30 of the inverted V-shaped fin 26 do not in these preferred embodiments slope down at the same angle with respect to inner surface 16 of tubular member 10. Accordingly, the shape of the several spiral grooves 24 between the spirally disposed fins 26 is that of an irregular trapezoid, as shown in FIG. 2.

The structure of inverted substantially V-shaped fin 26 preferably has a substantially rounded apex 34. In a present embodiment, the ratio of the height of the spirally disposed fins 26 to inner diameter 22 of elongated tube 12 is approximately 0.023. The helical angle of the spirally disposed fins 26, and also the spirally disposed grooves 24 set forth therebetween, is approximately 20°, although in preferred embodiments a range of 18°-22° may be utilizable.

In some preferred embodiments and sizes, the pitch of the spirally disposed fins 26 is approximately 0.021 inches. The defined wall thickness 20 of elongated tube 12 is approximately 0.012 inches. Spirally disposed fins 26 of the improved split resistant tubular heat transfer member 10 of the present invention may be separated along inner diameter 22 of elongated tube 12 by the distance of approximately 0.013 inches. Outer diameter 18 of circular transverse cross-section 13 of elongated tube 12 is approximately 0.375 inches in such embodiments.

The improved split resistant tubular heat transfer member 10 of the present invention may be formulated from refrigerant grade copper or other metal stock by means well known to those of ordinary skill in the art. In particular, in some of the useful methods of formation, a mandrel containing grooves and ridges thereon may be inserted within the inner diameter of a piece of smooth wall tubing for embossment of the mandrel grooves and fins onto the interior surface of the tubing by means of disposition of pressure on the exterior surface of the tubing. Such pressure on the exterior of the tubing may be brought about by means of ball bearings, roller bearings, or other apparatus such as disks disposed to revolve upon an arbor. In these embodiments, the exteriorly disposed ball bearings, roller bearings or disks displace the flowable metallic material of the tube wall, causing the material to deform downwardly and inwardly into the grooves of the mandrel structure in order to form an interior rib structure. According to known methods, the exterior surface of the tubular member may be smoothed with rollers or other suitable apparatus in order provide a finished and smooth wall outer surface. In such methods of tube formation, the end portions of the improved split resistant tubular heat transfer member may be left in an unworked condition to provide for ease of subsequent flaring for purposes of installation of such tubular member within a refrigerant system.

In one preferred embodiment, the nominal outer diameter (O.D.) is 0.375 inches, with a wall thickness of 0.012 inches, and an internal diameter (I.D.) of 0.35 inches. Other embodiments may have nominal outer diameters of 0.500 inches (½ inch) or 0.3125 inches (5/16 inch), with corresponding wall thickness.

The basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. An improved split resistant tubular heat transfer member comprising an elongated expanded and seamless tube having a substantially circular transverse cross-section, said tube having an outer surface and an inner surface, and further having an outer diameter, a defined wall thickness and an inner diameter;

said tube inner surface having disposed therein a plurality of spiral grooves defining and separating a corresponding plurality of spirally disposed fins extending from said inner diameter of said tube;

said respective spirally disposed fins having sloped sides to form an inverted substantially V-shape having an apical angle of approximately 28°; and said apical angle of said fin being asymmetrical with respect to a radius of said circular transverse cross-section.

2. The improved split resistant tubular heat transfer member of claim 1 wherein said inverted substantially V-shaped fin has a substantially rounded apex.

3. The improved split resistant tubular heat transfer member of claim 1 wherein the ratio of the height of said spirally disposed fins to said inner diameter of said tube is approximately 0.023.

4. The improved split resistant tubular heat transfer member of claim 1 wherein the helical angle of said spirally disposed fins is approximately 18°-22°.

5. The improved split resistant tubular heat transfer member of claim 1 wherein said spiral grooves are substantially trapezoidal in shape.

6. The improved split resistant tubular heat transfer member of claim 1 wherein the pitch of said spirally disposed fins is approximately 0.021 inches.

7. The improved split resistant tubular heat transfer member of claim 1 wherein the wall thickness of said elongated tube is approximately 0.012 inches.

8. The improved split resistant tubular heat transfer member of claim 1 wherein said spirally disposed fins are separated along the inner diameter of said elongated tube by the distance of approximately 0.013 inches.

9. The improved split resistant tubular heat transfer member of claim 1 wherein said elongated tube has 53 essentially evenly spaced, spirally disposed fins.

10. The improved split resistant tubular heat transfer member of claim 1 wherein said outer diameter of said circular transverse cross-section of said elongated tube is approximately 0.375 inches.

11. An improved split resistant tubular heat transfer member comprising an elongated tube having a substantially circular transverse cross-section, said tube having an outer surface and an inner surface, and further having an outer diameter, a defined wall thickness and an inner diameter;

said tube inner surface having disposed therein a plurality of spiral grooves defining and separating a corresponding plurality of spirally disposed fins extending from said inner diameter of said tube;

said respective spirally disposed fins having sloped sides to form an inverted substantially V-shape having an apical angle of approximately 28°; and said spiral grooves having a ratio of the cross-sectional area thereof to the depth thereof of approximately 0.01475 inches;

said radius intersecting a said spirally disposed fin and forming respective angles of approximately 13° and approximately 15° with the sloped sides of said inverted substantially V-shaped fin.

12. The improved split resistant tubular heat transfer member of claim 1 wherein said elongated tube has approximately 50 said spirally disposed fins.

13. An improved split resistant tubular heat transfer member comprising an elongated expanded and seamless tube having a substantially circular transverse cross-section, said tube having an outer surface and an inner surface, and further having an outer diameter, a defined wall thickness and an inner diameter;

said tube inner surface having disposed therein a plurality of spiral grooves defining and separating a corresponding plurality of spirally disposed fins extending from said inner diameter of said tube;

said respective spirally disposed fins having sloped sides to form an inverted substantially V-shape having an apical angle of approximately 28°, and the distance along the curve of the inner surface of the tube between the termination of one fin and the beginning of the next fin being the bottom wall distance;

the distance between the apex of one fin and the next fin being the pitch of the fin, and the ratio of the pitch distance to the bottom wall distance being approximately 1.62.

* * * * *